United States Patent [19]

Costa et al.

[11] Patent Number: 4,489,931

[45] Date of Patent: Dec. 25, 1984

[54] DEVICE FOR AUTOMATICALLY POSITIONING A SHEET ON A PLATEN OF AN OFFICE MACHINE

[75] Inventors: Armando Costa; Giovanni Verani, both of Ivrea, Italy

[73] Assignee: Ing. C. Olivetti & C., S.p.A., Ivrea, Italy

[21] Appl. No.: 313,303

[22] Filed: Oct. 20, 1981

[30] Foreign Application Priority Data

Oct. 24, 1980 [IT] Italy ..... 68630 A/80

[51] Int. Cl.[3] ..... B65H 29/06; B65H 5/12; B65H 5/14

[52] U.S. Cl. ..... 271/277; 271/4; 271/275; 271/82; 400/625; 400/629

[58] Field of Search ..... 271/4, 277, 275, 82; 400/624, 625, 629, 630, 631, 658; 346/138; 101/232

[56] References Cited

U.S. PATENT DOCUMENTS 3,430,748 3/1969 Parri ..... 400/629
3,918,707 11/1975 Villemer et al. ..... 271/277
4,072,306 2/1978 Idstein ..... 271/82
4,138,102 2/1979 Palmer ..... 271/277

*Primary Examiner*—Bruce H. Stoner, Jr.
*Assistant Examiner*—James E. Barlow
*Attorney, Agent, or Firm*—Banner, Birch, McKie & Beckett

[57] ABSTRACT

Device for automatically positioning a sheet on an office machine platen, including a lower guide element to guide the sheet toward the writing line of the platen and an upper guide element to guide the sheet towards the top. During the introduction of the sheet, an electromagnet is energized to let the lower guide element turn with the platen, accompanying the sheet beyond the writing line. The electromagnet also causes the contemporary separation of the upper guide element from the platen. When the sheet reaches a predetermined position with respect to the writing line, the electromagnet is de-energized and a spring again brings the two elements to the rest position. An automatic introduction mechanism sequentially transfers the sheets from a hopper to the platen and from the platen to a sheet stacker.

2 Claims, 5 Drawing Figures

DEVICE FOR AUTOMATICALLY POSITIONING A SHEET ON A PLATEN OF AN OFFICE MACHINE

BACKGROUND OF THE INVENTION

This invention refers to a device for automatically positioning a sheet on a platen of an office machine, including a guide element to guide a sheet towards the writing line and an element to guide the sheet over said writing line. The device is, according to the invention, particularly fit to be used in typewriting machines, accounting machines, terminals and similar machines for office use, in which the printing unit is movable with respect to the writing platen, which can only turn with respect to the fixed sides, without translating. In this kind of machine, to let the printing unit freely translate along the writing line from a platen end to another, the driving elements of the sheet must be placed only upon and under said writing line. Normally, to introduce a sheet in the machine and to position it correctly on the platen, the operator must manually operate the platen to drive the sheet towards the upper driving elements and to prevent interference with the printing unit which, in this circumstance, must be removed from the platen. The technical problem that this invention intends to solve is the realization of a device which permits the automatic positioning of a sheet with respect to a writing platen of an office machine which is easy, reliable and cheap, and which does not require previous removal of the printing unit from the writing platen.

SUMMARY OF THE INVENTION

To solve this technical problem, the device according to the invention has an electromagnet which controls the guide element to couple it selectively to the platen and to let it turn together with the platen, to let the sheet go over the writing line a predetermined amount, and to bring the sheet to a hold-area of the guiding element. This and other characteristics of the invention will be made clear by the following description of a preferred form of the invention, furnished to explain and not to limit the invention, with the help of herewith included drawings.

DESCRIPTION OF THE INVENTION

Figure 1:
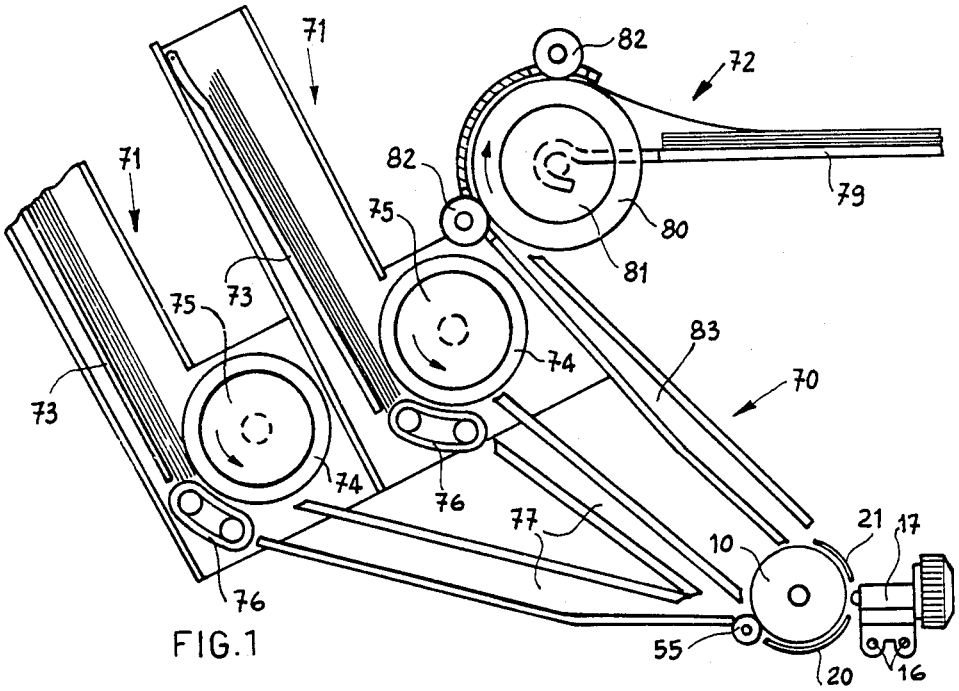
FIG. 1 is a lateral schematic view of the office machine on which the device according to the invention has been mounted.

The device according to the invention is able to be mounted on a typewriter machine, accounting machine, terminal and similar office machine, and includes a writing platen 10 (FIGS. 1, 3) mounted on fixed sides 11, only one of which is shown on the figure. The platen 10 is selectively turned by an electrical motor 18 (FIG. 2) through a toothed belt 12 and a couple of pulleys 13 and 14, respectively connected with the motor shaft and with a shaft 19 of the platen 10. The motor 18 is driven by a control circuit 6 and a data processing unit 7, which receives input from a console 8 or a data line 9.

In front of a writing line 15 (FIG. 3) of platen 10 is movable a printing unit 7 of known type, for example of type described on the U.S. Pat. No. 4,010,836 assigned to the same assignee as the present invention.

The device according to the invention comprises a first guiding element 20 (FIGS. 3 and 4) situated below platen 10 and a second guiding element 21 situated above platen 10. Both elements 20 and 21 are composed by a metallic tile substantially concentric to platen 10 and with the same length.

Figure 2:
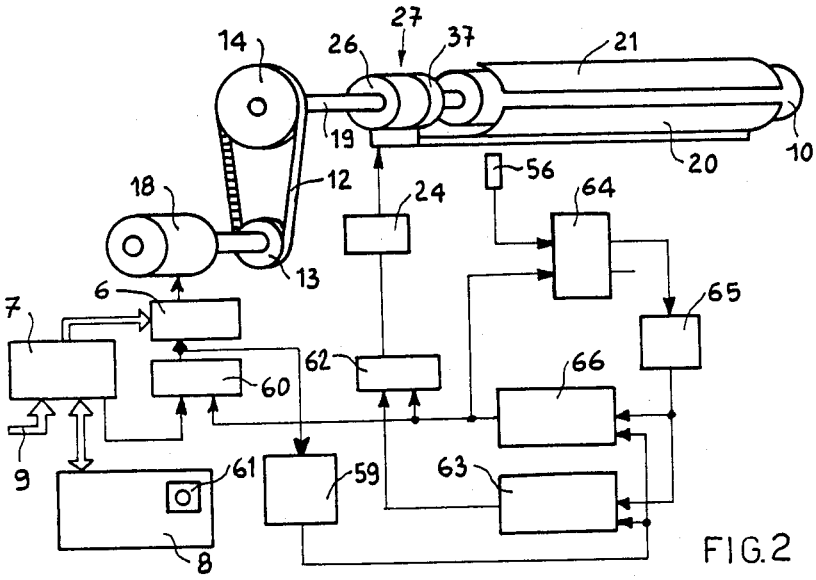
FIG. 2 is a schematic showing of the control unit of the device according to the invention.
Figure 3:
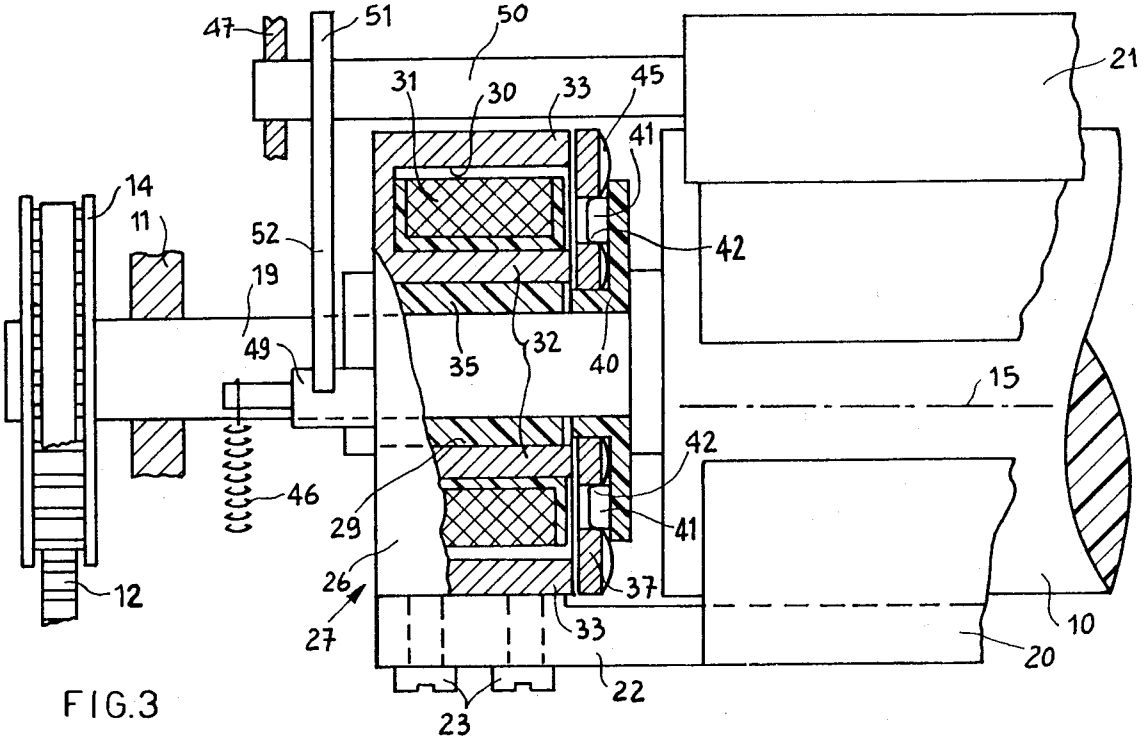
FIG. 3 is an elevational view, enlarged and partially sectioned, of the device according to the invention.

The lower guide element 20 is fixed in any known way, for example through a bar 22 and screws 23, to a core 26 of an electromagnet 27 of rotating type, mounted coaxial to platen 10 and actuatable by an amplifier 24 (FIG. 2). The core 26 is of ferro-magnetic material and has a central hole 29 (FIG. 3), an annular cavity 30 in which is situated an excitation coil 31, and two pole shoes 32 and 33, one inner and the other outer.

A bushing 35 of plastic material is interposed between shaft 19 and core 26, to allow these two elements to freely rotate one with respect to the other. An armature 37 composed by a ferro-magnetic plate is coaxially mounted on shaft 19 of platen 10 opposed to pole shoes 32 and 33 of the electromagnet 27. Between the plate 37 and shaft 19 is interposed an element 40 of plastic material which has two pins 41, diametrically opposed, situated in correspondent holes 42 in plate 37. A spring 45 of known type is interposed between element 40 and plate 37 to keep plate 37 slightly spaced from pole shoes 32 and 33. A spring 46 (FIG. 4) extends between a rib 48 of a fixed frame 47 of the machine on which is mounted the device and a pin 49 of core 26, and urges the core 26 and the lower guide element 20 in clockwise direction. The upper guide element 21 is fixed to a shaft 50 (FIGS. 3, 4), hinged on frame 47.

Figure 4:
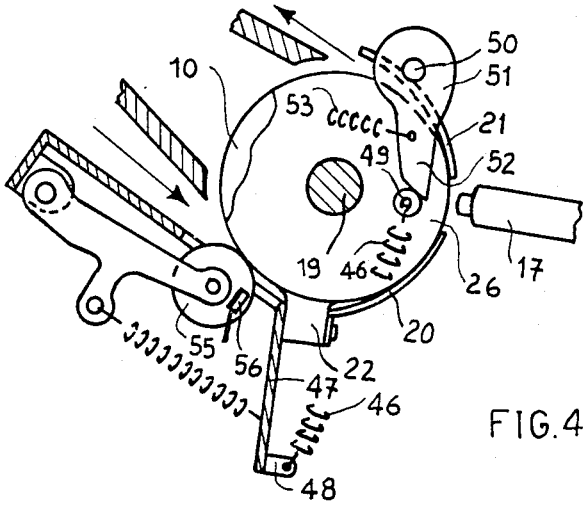
FIG. 4 is a lateral view, enlarged and partially sectioned, of the device according to the invention, in a rest position.

A lever 51 is also fixed on shaft 50 and has a lower arm 52 cooperating with pin 49 of core 26 through a spring 53. A set of small sheet finger rollers 55 is situated under the platen 10 (FIG. 4). Corresponding with these rollers 55 is situated a sensor 56, for example of photoelectrical type, which in known way, is able to detect the passage of a sheet edge, generating a correspondent electrical signal. Upon sheet introduction, the electrical motor 18 (FIG. 2) and the electromagnet 27 are controlled by a circuit which includes a first flip-flop 60, having an output connected to the control circuit 6 of motor 18 and one SET input actuatable by a start-cycle key 61 of console 8. A second flip-flop 62 has an output connected to the amplifier 24 of the electromagnet 27 and one SET input connected to the input of a first counter 63. A third flip-flop 64 has an output connected to the input of an oscillator 65 and one SET input connected to the sensor 56. The oscillator 65 output is connected to the input of a counter 66, which has its output connected to the three RESET inputs of flip-flops 60, 62 and 64. Moreover, the counters 63 and 66 can be preselected with a predetermined value by a circuit 59 actuatable by flip-flop 60.

It is clear that if the machine on which is mounted the device according to the invention is of micro-programmed type, the functions realized by the components of FIG. 2 are effectuated through suitable machine micro-programs in known way, without modifying the acutation of the mechanism.

Figure 5:
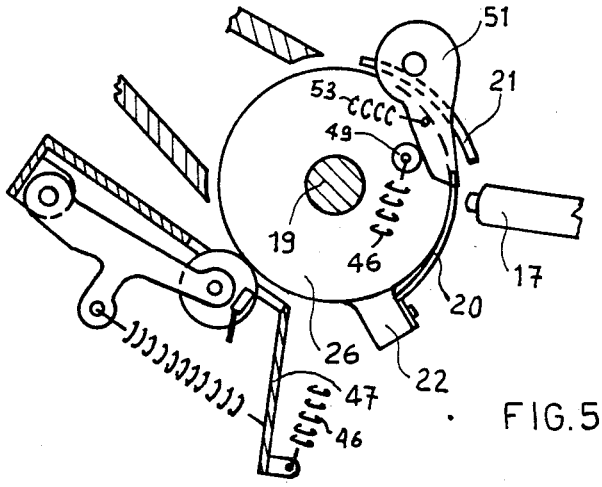
FIG. 5 is a lateral view, enlarged and partially sectioned of the device according to the invention, in an operating position.

The device so far described functions as follows:

In rest position the three flip-flops 60, 62 and 64 are reset, the motor 18 is stopped and the coil 31 is deactivated. The lower guide element 20 is positioned under the writing line 15 (FIG. 5), and is held by the spring 46 against the fixed frame 47 (FIG. 4). The upper guide element 21 is lowered against the platen 10. For automatically inserting and positioning a sheet with respect to the platen 10, in a predetermined position as regards the writing line 15, first of all the start-cycle key 61 is actuated (FIG. 2). In this way the flip-flop 60 is actuated, the counters 66 and 63 are charged with their reference value, and the motor 18 is driven to run; the platen 10 and disk 37 are also running. The paper is then introduced between the rollers 55 (FIG. 4) by hand, or automatically as after described, and the platen 10 drives the sheet edge towards the writing line 15. When the sheet passes sensor 56, this latter generates an electrical signal which sets the flip-flop 64 (FIG. 2), starting in this way the oscillator 65 to generate a set of pulses which are sent to the binary counter 63 and 66. After a time $t_1$ during which the sheet arrives at the upper end of guide element 20, the counter 63 gives an output signal which sets the flip-flop 62, energizing the coil 31 of the electromagnetic 27. Owing to the magnetic flux produced by the excitation of coil 31, the plate 37, which is running with the platen 10, is attracted by the pole shoes 32 and 33. In this way the core 26 and the lower guide element 20, are also driven to rotate with the platen 10, against the action of spring 46 (FIG. 4). The pin 49 by rotating in a counterclockwise direction with the core 26 moves upwards, so causing also the lever 51 and the upper guide element 21 to rotate in a counterclockwise direction; in this manner the upper guide element 21 leaves the platen 10, going to the position as shown in FIG. 5. After a time $t_2$ since the sheet passed the sensor 56, the counter 66 gives the signal which resets the three flip-flops 60, 62 and 64, stopping the motor 18 and de-energizing the coil 31 of the electromagnet 27. The springs 46 and 53 bring the guide elements 20 and 21 and core 26 to the rest position. The introduced sheet has its upper edge under the guide element 21, and positioned at approximately 8 mm. over the writing line 15, ready to be printed on the first line by the printing unit 17. Obviously, after due adjustment of circuit 59, the content of counters 63 and 66 can be modified to position the sheet at different levels with respect to the writing line 15.

According to a further aspect of the invention, a mechanism 70 (FIG. 1) can be connected to the device here above described to transfer sequentially the sheet to be printed from at least one hopper 71 towards the writing platen 10 and from the platen to a sheet stacker 72.

Each hopper 71 includes a plate 73 on which the sheets to be typed rest, a stripping roller 74, which is rotated in a counterclockwise direction by an electrical motor 75, and a rubber belt 76 situated against the roller 74 which allows only one sheet at a time to go through. Guides 77 are disposed between each hopper 71 and platen 10 to drive the sheets toward the platen. According to a characteristic of the invention, the sheet stacker 72 is turned towards the fore side of the machine (to the right in FIG. 1), to allow the typed sheets to be collected and stacked according to the order in which they have been fed. The hopper 72 includes a base plate 79, situated substantially horizontally, a roller 80 which is run in clockwise direction by an electrical motor 81 and some small rollers 82, which hold the paper against roller 80. A guide 83 is situated between the upper guide element 21 and the roller 80 to drive the typed sheet from the writing platen 10 towards the roller 80.

Obviously, the described device, can be modified with addition of parts without going out of the limits of this invention.

We claim:

1. A device for automatically positioning a sheet with respect to a writing line of a platen of an office machine, comprising means for rotating said platen, a first guide element for guiding said sheet towards said writing line, a second guide element for guiding said sheet beyond said writing line, electromagnet means for coupling said first guide element to said platen in such manner that said first guide element rotates together with said platen when said platen rotates, and control means for controlling said rotating means and the energization of said electromagnet means to drive said sheet beyond said writing line by a predetermined amount until said sheet is brought into cooperation with said second guide element, wherein said electromagnet means comprises a substantially cylindrical core rotably mounted with respect to said platen and moulded to define a couple of pole shoes coaxial therebetween, an armature angularly fixed with respect to said platen and opposed to said pole shoes, and an exciting coil for generating a magnetic flux for coupling said armature to said pole shoes.

2. A device according to claim 1, wherein said armature is axially movable with respect to said platen and wherein a spring holds said armature normally spaced from said core, so that in "off" position said armature and core can freely rotate one with respect to the other.

* * * * *